United States Patent [19]

Volk, Jr.

[11] 4,068,505

[45] Jan. 17, 1978

[54] LOCKING DEVICE

[75] Inventor: Kenneth Q. Volk, Jr., San Marino, Calif.

[73] Assignee: Public Storage, Inc., Pasadena, Calif.

[21] Appl. No.: 772,027

[22] Filed: Feb. 25, 1977

[51] Int. Cl.[2] ..... E05B 67/38; E05C 1/04; E05C 13/02

[52] U.S. Cl. ..... 70/56; 70/128; 292/148

[58] Field of Search ..... 70/54–56, 70/81, 83, 128, 129, 417, 418; 292/57, 58, 148, 150, 281

[56] References Cited

U.S. PATENT DOCUMENTS

| | | | |
|---|---|---|---|
| 918,316 | 4/1909 | Harris | 292/148 |
| 3,334,933 | 8/1967 | Ehlers | 70/129 |
| 3,953,062 | 4/1976 | Maston | 70/128 |
| 4,031,719 | 6/1977 | Klingler | 70/56 |
| 4,033,156 | 7/1977 | Cottingham | 70/56 |

*Primary Examiner*—Robert L. Wolfe
*Attorney, Agent, or Firm*—Elwood S. Kendrick; Patrick F. Bright

[57] ABSTRACT

A locking device includes a base having openings therein for joining the base to a first surface, such as the surface of the door, and a cover hinged to the base plate by a solid bar passing through apertures in flanges near the upper end of the base plate and cover. This solid bar is sufficiently long to engage an opening in a second surface, such as a door jamb. Joined to and extending laterally from the solid bar is a second bar that lies between the flanges of the cover plate, thus confining the second bar to the space between them, and preventing removal of the solid bar from the device. Projecting from the inner surface of the plate and from the inner surface of the cover are lock-receiving flanges having apertures which lie proximate one another when the cover plate is closed against the base. The apertures in these lock-receiving flanges lie at least partly in the same plane, permitting the hasp of a padlock to pass through both, thus locking the cover to the base plate. When the solid bar engages the opening in the second surface, the second bar lies on the side of the lock-receiving flanges nearer the opening. Locking the flanges together prevents disengagement of the solid bar from the opening in this situation.

8 Claims, 4 Drawing Figures

LOCKING DEVICE

This invention relates to a device for use with locks such as padlocks. The locking device largely shields the shackle of the padlock from attack by would-be intruders, yet is simple and easily manipulated by the unsophisticated.

This invention provides a locking device including a base plate and a cover plate joined thereto through hinges. Both base plate and cover plate include flanges extending laterally from opposite sides of the base plate, each flange including an aperture located near complementary ends of the two plates. The base plate and the cover plate flange apertures lie at least partly, and preferably wholly, in the same plane to facilitate receiving a multi-functional first bar means, described hereafter. The flanges joined to the base plate and to the cover plate preferably extend laterally from that plate at approximately right angles, and these flanges are preferably formed integrally with the plates. The base plate includes means for joining the plate to a first surface, such as a door or door jamb. Such means may be, and preferably are, one or more openings for receiving fasteners such as screws or bolts.

The cover plate flanges preferably extend along a substantial portion of the length of the cover so as to bridge a substantial portion of the space between the edges of the cover and base plates when the cover is closed over the base plate. Although the flanges bridging the spaces between the edges on opposite sides of the base plate and cover plate are preferably joined to the cover, they may be joined to the base plate instead. In this case, the cover flanges should be at least sufficiently large to accommodate the apertures that receive the first bar means. In another embodiment, both cover and base plate may have flanges along a substantial portion of the opposite sides of each, provided that, when the cover plate is closed against the base plate, the space between the edges of the cover and base plate on opposite sides extend at least to one another, thus bridging the spaces between the edges of the cover and base on both sides.

Passing through the apertures in the base plate and cover plate flanges is a first bar means, thus hinging the base and cover plates to one another. The first bar means is sufficiently strong to resist bending under considerable stress, and is sufficiently long to engage a second surface such as an opening in a door jamb or a bracket mounted on a door jamb, thus bolting this second surface to the surface carrying the locking device.

Joined to and extending laterally from the first bar means is a second bar means that is also sufficiently strong to resist deformation under considerable stress. The second bar means lies between the base and cover plate flanges, and serves to retain the first bar means in the apertures of the base and cover plates. The second bar means also cooperates with the lock-receiving flanges described hereafter to prevent disengagement of the first bar means from the second surface when the cover plate is closed against and locked to the base plate.

Joined to the surface of the base plate is a lock-receiving flange having a lock-receiving aperture therein. A complementary lock-receiving flange is joined to the inner surface of the cover and this flange also includes a lock-receiving aperture. The two lock-receiving flanges lie at least partly in the same plane when the cover plate is closed against the base plate. Preferably, when the cover plate is closed, the lock-receiving flanges lie in close proximity, and the lock-receiving apertures in these flanges lie in the same plane. This permits the shackle of a lock to pass through both apertures, thus locking the base and cover plate together. Alternatively, the lock-receiving flanges may be laterally spaced from one another sufficiently far to permit the second bar means to lie between them when the cover plate is closed over the base plate and the first bar means is engaging the second surface. Under these circumstances, the lock shackle may pass behind the second bar means thus further deterring attempts to attack the lock shackle.

The invention may be understood more completely by reference to the accompanying drawings, in which.

Figure 1:
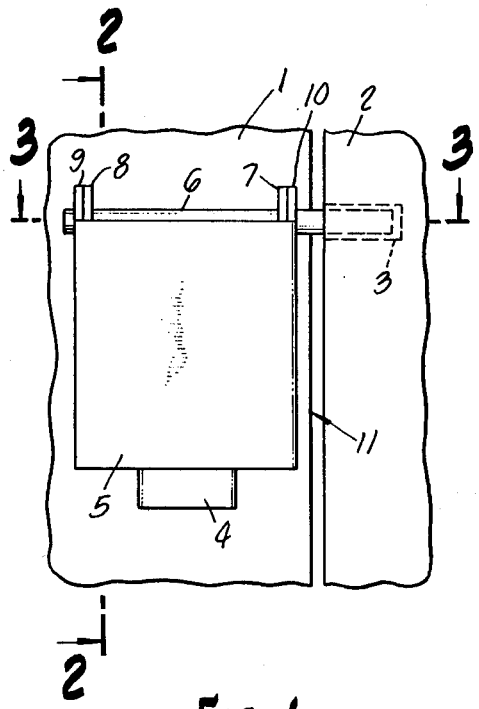
FIG. 1 is a front plan view of the locking device mounted on a first surface such as a door that is to be bolted to a second surface such as a door jamb.

FIG. 1 shows the locking device of the invention, generally designated 11, mounted on first surface 1, which may be the surface of a door. In this figure, the locking device is utilized to bolt door surface 1 to door jamb 2 when first bar means 6 penetrates into opening 3 in door jamb 2.

Figure 4:
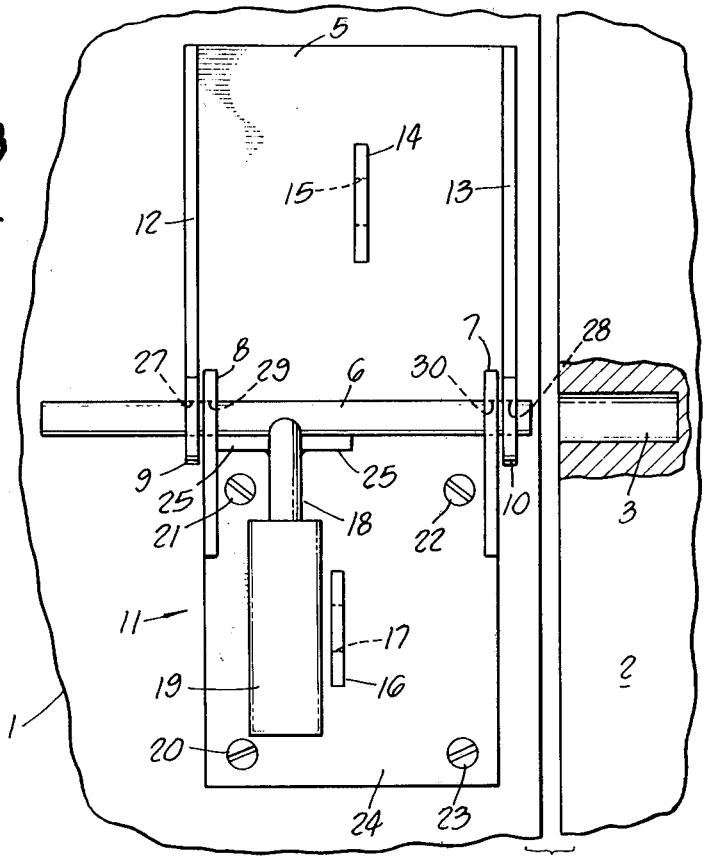
FIG. 4 is a front plan view of the locking device with the cover open and the padlock removed from the device.
Figure 2:
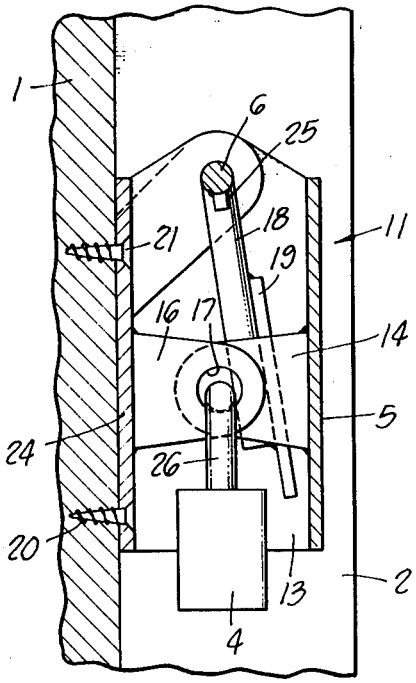
FIG. 2 is a sectional view taken on line 2—2 of FIG. 1, and shows an edge view of the new locking device with the cover closed against the base plate.
Figure 3:
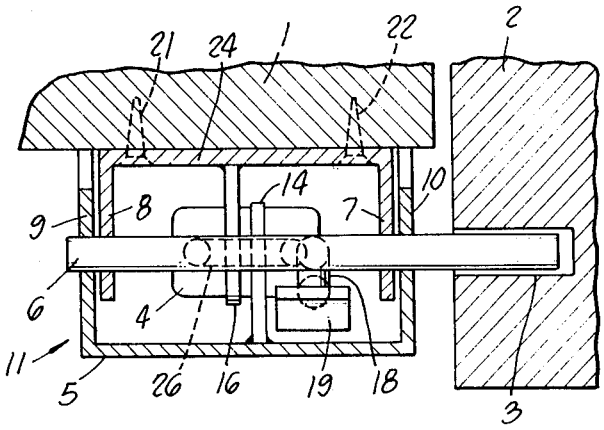
FIG. 3 is another sectional view taken along line 3—3 of FIG. 1, showing a top view of the locking device.

Referring now to FIGS. 2, 3 and 4, locking device 11 includes cover plate 5 having integrally formed flanges 12 and 13 extending laterally along the entire length on opposite sides thereof. Apertures 27 and 28 in cover plate flanges 9 and 10 lie in the same plane to accommodate receiving first bar means 6 through both. Joined at about a 90° angle to the inner surface of cover plate 5 is lock-receiving flange 14, a semi-circular member joined to cover plate 5 along its base, and that includes lock-receiving aperture 15 therein.

Base plate 24 has a plurality of openings 20, 21, 22 and 23 through which screw fasteners pass into the surface of door 1 to hold the base plate 24 thereto. Extending laterally from base plate 24 are integrally formed flanges 7 and 8 including apertures 30 and 29, respectively. These apertures lie at least partly in the same plane to facilitate receiving first bar means 6 therethrough. First bar means 6 then passes through apertures 27, 29, 30 and 28 to hinge together base plate 24 and cover plate 5. Joined at about a 90° angle to the inner surface of base plate 24 is lock-receiving flange 16, similar to flange 15, and having lock-receiving aperture 17 therein.

Joined to and appended from rigid first bar means 6 is rigid second bar means 18, which extends to and beyond the lock-receiving flange 16 and to and beyond lock-receiving flange 14 as well when the cover plate is closed against the base plate, as FIGS. 2 and 3 show. Joined to second bar means 18 is plate 19, which extends to and beyond both lock-receiving flanges 14 and 16. Spacer means 25 is joined to bar means 6 to limit lateral movement of the bar means 6 and of second bar means 18.

In FIG. 4, first bar means 6 is shown disengaged from opening 3 in door jamb 2, and second bar means 18 is shown lying to the left of lock-receiving flanges 14 and 16. To engage first bar means 6 in opening 3, cover plate 5 is raised, and plate 19 and second bar means 18 are raised, and moved to the right of the lock-receiving flange (the side nearer opening 3). This movement carries bar means 6 into opening 3, thus bolting the surface of door 1 to door jamb 2. Bar means 18 and plate 19 are then rotated downwardly against base plate 24 on the side of lock-receiving flanges 14 and 16 nearer door jamb 2, and cover plate 5 is rotated downwardly against base plate 24 until flanges 12 and 13 abut surface 1. In this posture apertures 15 and 17 in flanges 14 and 16 lie at least partly in the same plane, and the shackle 26 of lock 4 may mass simultaneously through both apertures. With lock 4 locked, cover plate 5 is secured to base plate 24, and interlocked apertures 14 and 16 block movement of second bar means 18 to the left (the side of the lock-receiving flanges farther from opening 3), precluding disengagement of bar means 6 from opening 3. Lock-receiving flanges 14, 16 are preferably attached to base plate 24 and cover plate 5 at least a sufficient distance from the bottom edge of base plate and cover plate to insure that shackle 26 lies substantially, preferably completely, in the space between base plate 24 and cover plate 5. This deters unauthorized persons from tampering with the shackle of the padlock.

Alternatively, the lock-receiving flanges 14 and 16 may be spaced farther apart laterally, thus permitting plate 19 and second bar 18 to lie between the lock-receiving flanges 14 and 16 when first bar means 6 is engaged in opening 3. In this posture, the shackle 26 of padlock 4 may pass behind plate 19 and bar 18, thus further minimizing the risk of unauthorized tampering with shackle 26.

What is claimed is:

1. Locking means including a base plate and a cover plate hinged thereto, the base plate including:

flanges extending laterally from opposite sides of said base plate, each base plate flange including an aperture near one end of said base plate, the apertures lying at least partly in the same plane, and means for joining the locking means to a first surface;

the cover plate including flanges extending laterally from opposite sides of said cover plate, each cover plate flange including an aperture near one end of said cover plate, said apertures lying at least partly in the same plane;

the cover plate flanges alone, the base plate flanges alone, or both together bridging the spaces between the edges of base and cover plates on said opposite sides;

said base plate and cover plate each including a lock-receiving flange on its inner surface, each lock-receiving flange including a lock-receiving aperture, said lock-receiving apertures lying at least partly in the same plane when said cover plate is closed against said base plate;

first bar means passing through the apertures in the base plate and cover plate flanges and joining the plates hingedly and being sufficiently long to engage a second surface when said second bar means lies on the side of at least one of said lock-receiving flanges nearer the second surface; and second bar means joined to and extending laterally from said first bar means at least to the lock-receiving flange on said base plate.

2. The locking means of claim 1 wherein said means for joining the locking means to said first surface includes a plurality of holes for receiving fasteners.

3. The locking means of claim 1 wherein the base plate flanges are integral with said base plate.

4. The locking means of claim 1 wherein the cover plate flanges are integral with the cover plate.

5. The locking means of claim 1 wherein a plate joined to said second bar means extends at least to the base plate lock-receiving flange.

6. The locking means of claim 1 wherein each lock-receiving flange is a semi-circular plate joined at approximately right angles to each plate with the base of said semi-circular flange fastened to the plate.

7. The locking means of claim 1 wherein said cover plate flanges extend across substantially the entire space between the cover plate and the base plate when the cover plate is closed against the base plate.

8. The locking means of claim 1 wherein the lock-receiving flanges are laterally spaced from one another, the second bar means is placed between said lock-receiving flanges with the first bar means engaging the second surface when the cover plate is closed against the base plate.

* * * * *